US007726249B2

(12) United States Patent
Materna et al.

(10) Patent No.: US 7,726,249 B2
(45) Date of Patent: Jun. 1, 2010

(54) APPARATUS AND METHOD FOR ISOLATING ZONES OF AN INDUSTRIAL FURNACE

(75) Inventors: William R. Materna, Galena, IL (US); Fred Lindeman, Dubuque, IA (US); Timothy Park, Dubuque, IA (US)

(73) Assignee: Merkle International, Inc., Galena, IL (US)

( * ) Notice: Subject to any disclaimer, the term of this patent is extended or adjusted under 35 U.S.C. 154(b) by 371 days.

(21) Appl. No.: 11/799,674

(22) Filed: May 1, 2007

(65) Prior Publication Data

US 2008/0271655 A1 Nov. 6, 2008

(51) Int. Cl.
*F23M 5/02* (2006.01)
*F23M 5/06* (2006.01)

(52) U.S. Cl. ..... 110/339; 110/332

(58) Field of Classification Search ..... 110/331, 110/332, 338, 339, 340; 264/30; 202/267.1; 165/9.1; 266/280, 283, 285
See application file for complete search history.

(56) References Cited

U.S. PATENT DOCUMENTS 3,260,228 A 7/1966 Lingl
4,424,756 A 1/1984 Merkle
4,463,689 A 8/1984 James
4,473,015 A * 9/1984 Hounsel ..... 110/336
4,475,470 A 10/1984 Merkle
4,638,617 A 1/1987 James
4,705,475 A 11/1987 Coates
4,754,716 A 7/1988 Coates
4,809,621 A 3/1989 Materna
4,864,945 A 9/1989 Merkle
4,960,058 A 10/1990 Materna
5,357,540 A 10/1994 Merkle et al.
5,899,151 A 5/1999 Merkle, Jr. et al.
6,058,859 A * 5/2000 Colosimo, Jr. ..... 110/332
6,427,610 B1 * 8/2002 Coates et al. ..... 110/339
7,040,241 B2 5/2006 Coates

OTHER PUBLICATIONS

Co-Pending U.S. Appl. No. 11/799,673, filed May 1, 2007; inventors Fred Lindeman et al.; title Removable Filler Module.

* cited by examiner

*Primary Examiner*—Kenneth B Rinehart
*Assistant Examiner*—David J. Laux
(74) *Attorney, Agent, or Firm*—Pauley Petersen & Erickson

(57) ABSTRACT

This invention relates to an apparatus and a method for at least partially isolating a zone of an industrial furnace. The apparatus includes a hanger block and a hanger clamp. The method includes removably mounting a hanger block with respect to a furnace structure. A hanger clamp is engaged with the hanger block. A curtain structure is mounted in the hanger block, and the hanger clamp is mounted to an adjustable support or mechanism.

18 Claims, 4 Drawing Sheets

APPARATUS AND METHOD FOR ISOLATING ZONES OF AN INDUSTRIAL FURNACE

BACKGROUND OF THE INVENTION

1. Field of the Invention

This invention relates generally to industrial furnaces and, more particularly to, an apparatus and a method for at least partially isolating zones of the industrial furnace.

2. Discussion of Related Art

Industrial furnaces are used in many applications such as, but not limited to, producing glass on a tin bath, heat treating, smelting and/or refining metals, calcining coke, incinerating waste and the like. Industrial furnaces are often constructed of refractory materials, such as taught by U.S. Pat. Nos. 6,427,610 and 4,960,058, the entire teachings of which are incorporated by reference into this specification. The use of hanger brick for construction of a static wall or a roof structure is particularly effective in furnaces for making glass.

Often, industrial furnaces have multiple zones and thus require isolation between the zones. A stationary refractory wall can provide isolation but cannot meet the need, such as during furnace operation, to adjust the level of isolation between the zones. For example, moving a product between zones can be accomplished with an adjustable mechanism, apparatus and curtain structure.

The apparatus can be moveably mounted between structures of the industrial furnace, to isolate the zones. The conventional apparatus, in contact with the curtain structure, is raised or lowered by the adjustable mechanism. The apparatus is often constructed of stainless steel. High operating temperatures of the industrial furnace can warp the apparatus and prevent reliable adjustment of the isolation between the zones. Warping problems can result in a shutdown of the industrial furnace, to allow replacement or repair of the apparatus.

SUMMARY OF THE INVENTION

It is one object of this invention to provide an improved apparatus for isolating industrial furnace zones.

The above and other objects of this invention can be attained, at least in part, with an apparatus that at least partially isolates a zone of an industrial furnace. A hanger block with sides, ends, a bottom, a channel and a recess can be engaged with a hanger clamp. The hanger clamp is preferably, but not necessarily, moveably mounted with respect to the furnace structure.

The prior art generally does not teach an apparatus that avoids warping when exposed to high temperatures of an industrial furnace, particularly which provide a seal during furnace operation.

This invention also relates to a method for movably mounting a curtain structure within a void of a furnace structure. A moveably mounted hanger clamp can be engaged with a hanger block. The curtain structure can be removably mounted in a channel of the hanger block.

Other objects and advantages of this invention will be apparent to those skilled in the art from the following detailed description taken in conjunction with the appended claims and drawings.

BRIEF DESCRIPTION OF THE DRAWINGS

The above and other objects of this invention can be better understood when the specification is read in view of the drawings, wherein.

DETAILED DESCRIPTION OF THE INVENTION

Figure 1:
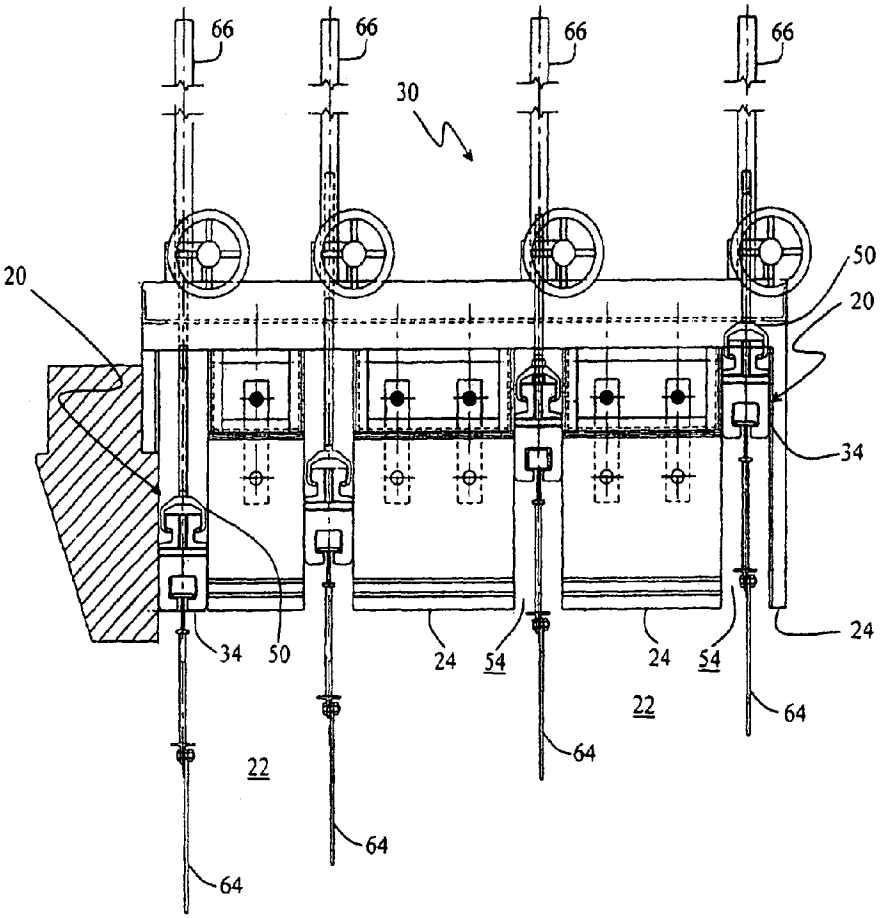
FIG. 1 is a partial sectional side view of an industrial furnace, according to one embodiment of this invention.

FIG. 1 shows a partial sectional side view of industrial furnace 30, according to one embodiment of this invention. Industrial furnace 30 can have many applications such as, but not limited to, producing glass on a tin bath, heat treating materials, smelting and/or refining metals, calcining coke, incinerating waste and any other similar method or process.

Apparatus 20 of this invention can at least partially isolate zone 22, such as formed between one or more structures 24. Structure 24 can comprise load bearing elements, such as beams and trusses or non-load bearing elements, including walls, roofs, covers, refractory dividers and the like. Zone 22 can be located at any suitable position, including the end portion of industrial furnace 30 and/or any other intermediate portion of industrial furnace 30. According to one embodiment of this invention, apparatus 20 comprises hanger block 34 and/or hanger clamp 50.

In another embodiment of this invention, hanger block 34 substantially fills void 54 between structures 24. Hanger block 34 can substantially seal void 54 to minimize leakage of internal atmosphere of industrial furnace 30, such as to a surrounding environment. Void 54 also can include the end portion of industrial furnace 30, so that apparatus 20 forms a door type closure. Void 54 between structures 24 includes void 54 internal to industrial furnace 30 as well as any void 54 that can extend to one or more perimeter walls of industrial furnace 30.

Hanger block 34 can be fabricated of metal, refractory, or any other suitable material capable of withstanding operating temperatures of industrial furnace 30. Such materials can include, but are not limited to, stainless steels, refractory, or engineered resins. Fabrication of hanger block 34 into shapes and of various materials is known in the arts. Outside corners of hanger block 34 can be rounded, squared and/or chamfered. The inside corners of hanger block 34 can be squared and/or curved.

According to another embodiment of this invention, hanger block 34 can be made from refractory materials, including refractory materials that can withstand relatively high temperatures and not become warped. Common refractory materials can include zircon, fireclay, silica, dolomite, magnesite, alumina, chromite and/or silicon carbide. However, one skilled in the art can choose any one or more of other suitable refractory materials.

In one embodiment of this invention, such as shown in FIG. 1, hanger clamp 50 engages or structurally mounts hanger block 34. Hanger clamp 50 can be fabricated of metal, refractory, or any other suitable material capable of withstanding operating temperatures of industrial furnace 30, including but not limited to steels, stainless steels, alloys, refractories and the like. Any suitable conventional structural clamp or other device known to those skilled in the art can be used as hanger clamp 50. Hanger clamp 50 preferably but not necessarily is movably mounted with respect to structure 24 of industrial furnace 30, for example to move curtain structure 64 into and out of zone 22.

Curtain structure 64 can be mounted or positioned within or with respect to hanger block 34. According to certain embodiments of this invention, curtain structure 64 is movable along longitudinal axis 49 of hanger block 34. Curtain structure 64 may be positionable in an inserted position and/or a withdrawn position with respect to zone 22. The withdrawn position can be useful for periodic maintenance or replacement of curtain structure 64, such as due to warping and/or other operational reasons. Replacement of curtain structure 64 can be performed while hanger block 34 is positioned within void 54 or after hanger block 34 has been removed from industrial furnace 30.

Curtain structure 64 can be fabricated from such materials capable of withstanding relatively high temperatures of industrial furnace 30. These materials can include steels, stainless steels, alloys, fiberglass, asbestos, refractory, rock wool, polyaramids and the like. In one embodiment of this invention, curtain structure 64 is made from stainless steel.

According to some embodiments of this invention, apparatus 20 is movably mounted with respect to structure 24 by linearly adjustable mechanism 66, which is capable of incrementally increasing or decreasing a partial isolation and/or a complete isolation between two or more zones 22 of industrial furnace 30. Linearly adjustable mechanism 66 can comprise an actuator with a hand operable wheel and/or one or more mechanical linkages, such as gears, screws, drive shafts and the like.

Other actuating devices can comprise electric motors, pneumatics, hydraulics and/or any other suitable implements, as readily adapted by one skilled in the mechanical arts. According to certain embodiments of this invention, linearly adjustable mechanism 66 is oriented in a substantially vertical position, allowing raising and lowering of curtain structure 64.

In other embodiments of this invention, linearly adjustable mechanism 66 can be oriented at any suitable angle, such as at 45 degrees or even horizontally, depending upon the design needs of industrial furnace 30. Operation of linearly adjustable mechanism 66 can be carried out during operation of industrial furnace 30 as well as during a shutdown mode.

Figure 2:
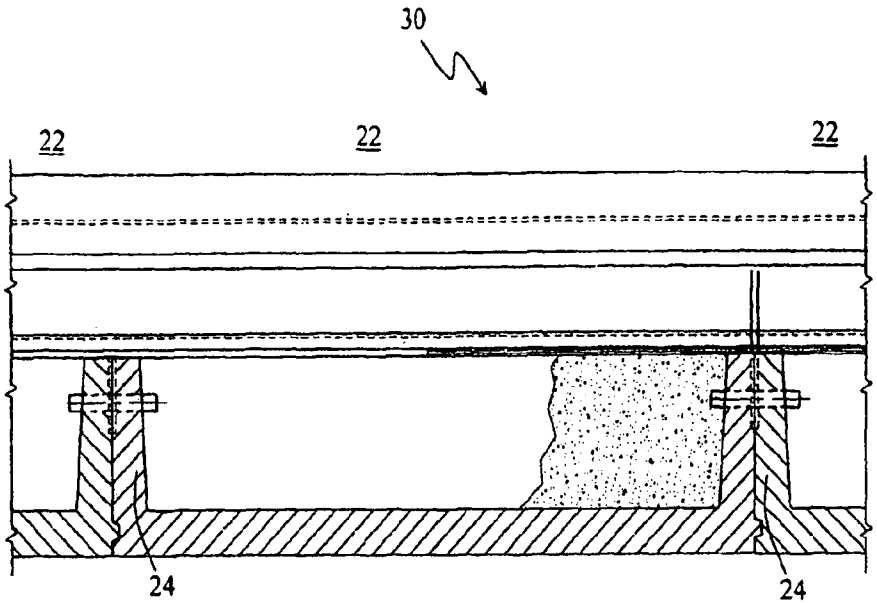
FIG. 2 is a partial sectional view of a portion of an industrial furnace, according to one embodiment of this invention.

FIG. 2 is a partial cross sectional view of an industrial furnace 30 comprising zones 22 and structures 24.

Figure 3:
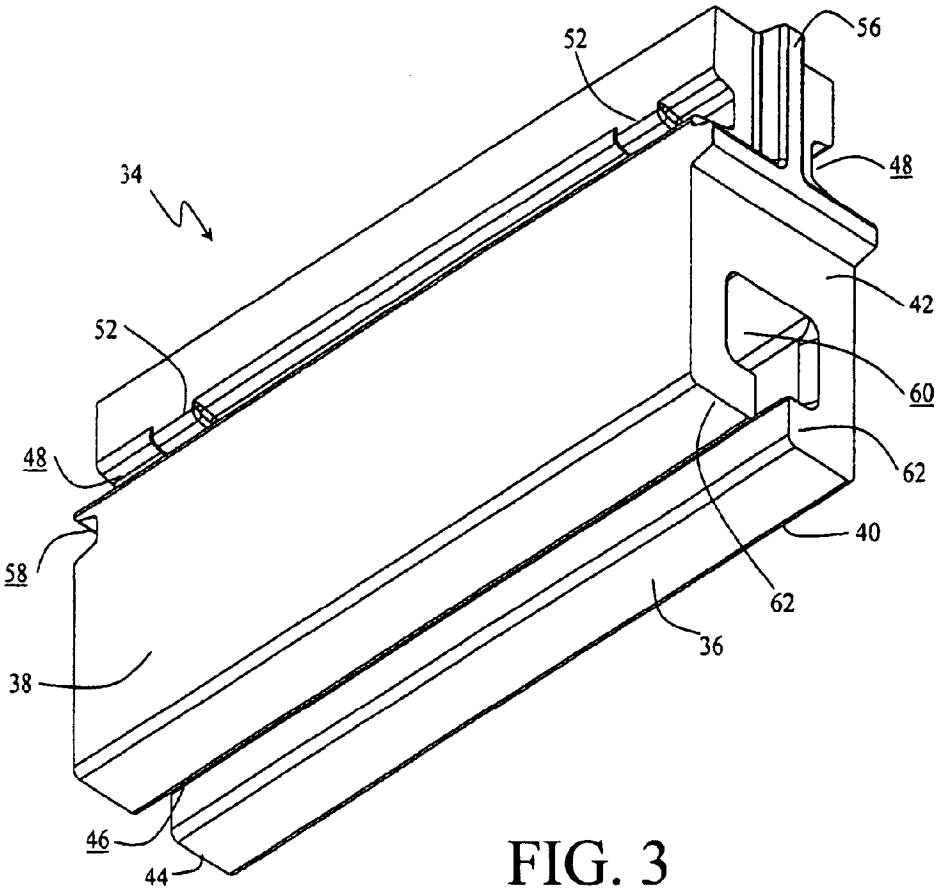
FIG. 3 is a perspective view of a hanger block, showing a channel and a recess, according to one embodiment of this invention.
Figure 4:
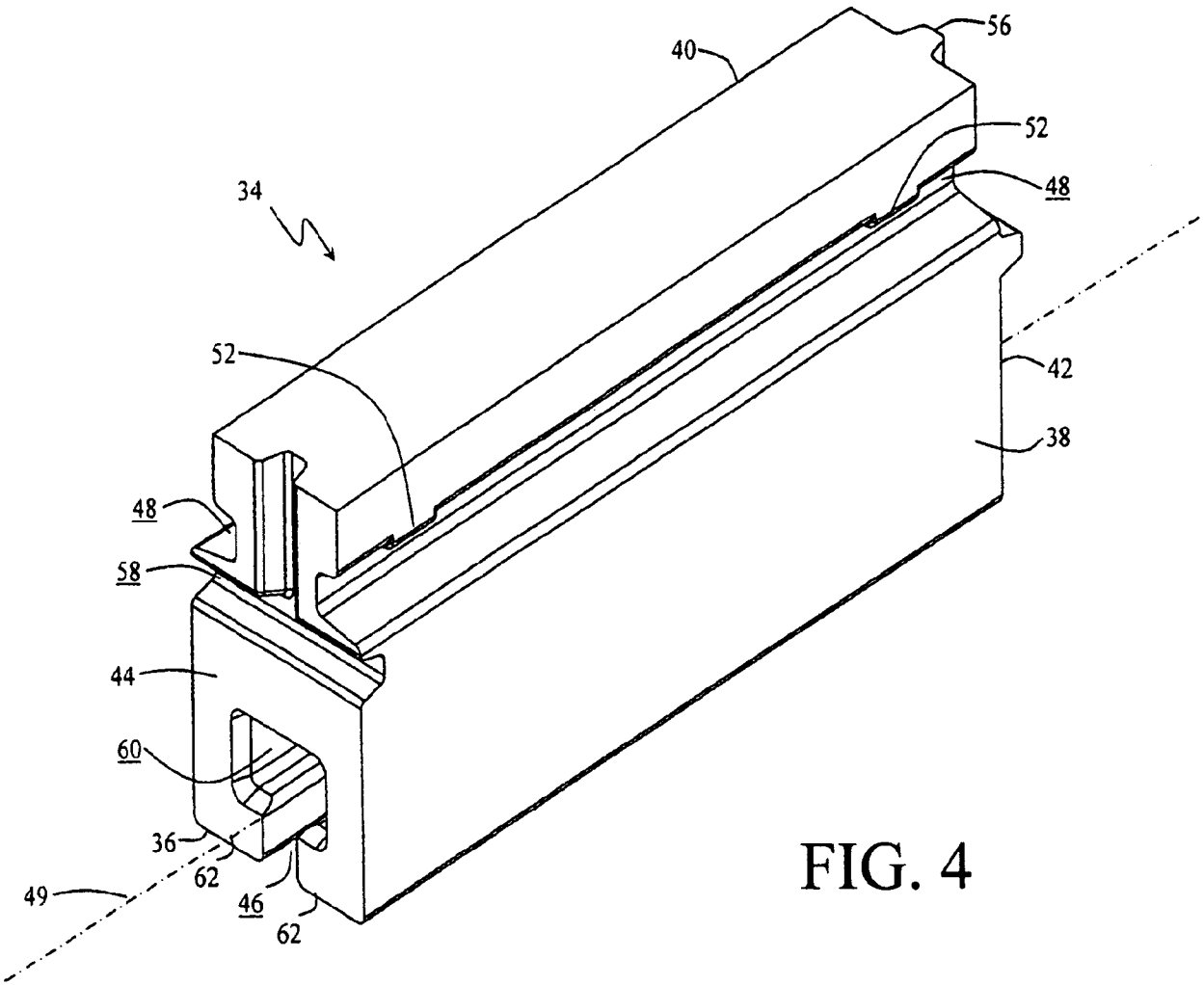
FIG. 4 is a perspective view of the hanger block opposite the view as shown in FIG. 3.

FIG. 3 and FIG. 4 show perspective views of hanger block 34. In some embodiments of this invention, hanger block 34 is elongated in a direction of or along first side 38 and/or second side 40. The length can be based on convenience during fabrication of hanger block 34 and/or design and installation of industrial furnace 30. In one embodiment of this invention, a cross section of hanger block 34 taken transverse to longitudinal axis 49 is generally rectangular.

According to certain embodiments of this invention, first side 38 and second side 40 are preferably but not necessarily generally parallel to each other.

Bottom 36 can be generally rectangular and can form channel 46. Channel 46 can be centrally positioned on bottom 36. In other embodiments of this invention, channel 46 can be offset from the center of bottom 36. First side 38 and/or second side 40 can form channel 46. In other embodiments of this invention, channel 46 runs generally parallel to at least one of first side 38 and/or second side 40.

Channel 46 may extend along at least part of or an entire length of hanger block 34. Channel 46 can end as a closed bore or channel within hanger block 34 or can extend to first end 42 and/or second end 44. Channel width 60 can narrow to form at least one shoulder 62. In other embodiments of this invention, two shoulders 62 are formed, such as by channel width 60.

According to one embodiment of this invention, shoulders 62 contact curtain structure 64.

Hanger clamp 50 may engage hanger block 34, such as at recess 48 formed in hanger block 34. Recess 48 can extend along part of or the entire length of hanger block 34. In other embodiments of this invention, two or more recesses 48 are formed in one or more external surfaces of hanger block 34. Each recess 48 can extend along first side 38 and/or second side 40.

According to one embodiment of this invention, at least one lug 52 fixes the position of hanger block 34 with respect to hanger clamp 50. Lug 52 can be a raised protuberance that contacts hanger block 34 and/or hanger clamp 50. One skilled in the mechanical arts understands that lug 52 can have any number of shapes including, but not limited to, a triangle, a square, a circle and/or any non-circular shape. Lug 52 can be separate and/or integral to hanger block 34 and/or hanger clamp 50.

In some embodiments of this invention, two lugs 52 are located or positioned within each recess 48 near the top and/or proximate to each of first end 42 and second end 44. In other embodiments of this invention, lug 52 is positioned on first side 38 and/or second side 40.

According to some embodiments of this invention, first end 42 has or forms ridge 56 and second end 44 has or forms groove 58 corresponding with ridge 56 of first end 42, and for example can include the same or substantially similar shape but possibly a negative image. A second hanger block 34 with groove 58 at an end position can engage or couple ridge 56 to extend the length of apparatus 20 when longitudinally positioned. According to one embodiment of this invention, a plurality of hanger blocks 34 can be arranged so that first end 42 is adjacent to second end 44, and so that ridge 56 and grove 58 contact or engage with each other to provide structural stability. Any other suitable structural arrangement can be used to lockingly position two or more hanger blocks 34 adjacent, abutting or next to each other.

In other embodiments of this invention, hanger blocks 34 are arranged so that first end 42 is next to, adjacent or abuts second end 44, without ridge 56 and/or groove 58. Ridge 56 preferably but not necessarily forms an inverted T shape and groove 58 can be shaped to correspond to or engage with the inverted T shape of ridge 56.

While in the foregoing specification this invention has been described in relation to certain embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An apparatus for at least partially isolating a zone of an industrial furnace, the zone formed at least partially by a structure of the industrial furnace, the apparatus comprising:

a hanger block having a bottom, a first side opposite a second side, and a first end opposite a second end;

the hanger block forming a channel at the bottom, the channel extending to at least one of the first end and the second end, a width of the channel converging at the bottom and forming at least one shoulder;

the hanger block forming at least one recess extending along at least a part of a length of at least one of the first side and the second side; and a hanger clamp engageable in the at least one recess, and the hanger clamp movably mounted with respect to the structure.

2. The apparatus of claim 1, wherein the structure of the industrial furnace is constructed of a refractory material.

3. The apparatus of claim 1, wherein the hanger block is constructed of a refractory material.

4. The apparatus of claim 1, wherein the channel is centrally positioned along the bottom.

5. The apparatus of claim 1, wherein the channel is generally parallel to at least one of the first side and the second side.

6. The apparatus of claim 1, wherein at least one lug extends from the hanger block and fixes a position of the hanger clamp with respect to the hanger block.

7. The apparatus of claim 1, wherein the first side and the second side are generally parallel to each other.

8. The apparatus of claim 1, wherein the hanger block substantially seals a void formed between the furnace structure and an additional furnace structure.

9. The apparatus of claim 1, wherein the first end has a ridge.

10. The apparatus of claim 9, further comprising a second hanger block with a groove at an end position of the second hanger block, and the ridge engageable with the groove.

11. The apparatus of claim 1, wherein a curtain structure is movable between an inserted position and a withdrawn position, and the curtain structure in the inserted position contacts the at least one shoulder.

12. The apparatus of claim 11, wherein at least a portion of a curtain structure is movable within the channel of the hanger block when the hanger block is positioned within a void formed between the furnace structure and an additional furnace structure.

13. The apparatus of claim 1, further comprising a plurality of hanger blocks wherein the hanger blocks are longitudinally positioned next to each other.

14. A method for movably mounting a curtain structure within a void formed between a furnace structure and an additional furnace structure, the method comprising:

movably mounting a hanger clamp;

engaging the hanger clamp with at least one hanger block; and removably mounting the curtain structure in a channel formed in the at least one hanger block.

15. The method of claim 14, further comprising movably mounting the hanger clamp from a linearly adjustable support.

16. The method of claim 14, wherein the hanger clamp engages within at least one recess of the at least one hanger block.

17. The method of claim 16, wherein at least one lug of the hanger block fixes a position of the hanger clamp with respect to the hanger block.

18. The method of claim 14, wherein the curtain structure is removably mounted within a channel of the hanger block.

* * * * *